US005898356A

United States Patent [19]

Gascoyne et al.

[11] Patent Number: 5,898,356

[45] Date of Patent: Apr. 27, 1999

[54] THERMALLY-ACTIVATED SWITCH FOR SHORT-CIRCUITING A BATTERY CELL

[75] Inventors: Peter Ffrecheville Gascoyne, Slaunton, United Kingdom; Geoffrey John Dudley, Marijkelaan, Netherlands

[73] Assignee: Agence Spatiale Europeenne, Paris Cedex, France

[21] Appl. No.: 08/687,955

[22] Filed: Jul. 29, 1996

[30] Foreign Application Priority Data

Aug. 3, 1995 [FR] France ..... 95 09458

[51] Int. Cl.[6] ..... H01H 61/01

[52] U.S. Cl. ..... 337/15; 337/14; 337/125; 337/327

[58] Field of Search ..... 337/14, 15, 17, 337/21, 298, 300, 308, 309, 327, 329, 331, 125

[56] References Cited

U.S. PATENT DOCUMENTS

| | | | |
|---|---|---|---|
| 3,213,345 | 10/1965 | Loftus | 337/15 X |
| 4,061,955 | 12/1977 | Thomas et al. | 320/6 |
| 4,252,869 | 2/1981 | Heitz et al. | 337/21 X |
| 5,025,119 | 6/1991 | Rogers et al. | 200/262 |
| 5,362,576 | 11/1994 | Clark et al. | 429/7 |

FOREIGN PATENT DOCUMENTS

| | | |
|---|---|---|
| 0 173 690 | 3/1986 | European Pat. Off. . |
| 0 226 360 | 6/1987 | European Pat. Off. . |
| 0 372 823 | 6/1990 | European Pat. Off. . |
| 0 501 802 A1 | 9/1992 | European Pat. Off. . |
| 0 665 568 A1 | 8/1995 | European Pat. Off. . |
| 1613968 | 6/1971 | Germany . |
| WO 85/04045 | 9/1985 | WIPO . |
| WO 88/00400 | 1/1988 | WIPO . |

*Primary Examiner*—Leo P. Picard
*Assistant Examiner*—Jayprakash N. Gandhi
*Attorney, Agent, or Firm*—Sughrue, Mion, Zinn, Macpeak & Seas, PLLC

[57] ABSTRACT

A thermally activated short-circuit switch for connection in parallel with a battery cell has first and second contact elements (6; 3) which are distinct from the electrodes of a diode, and thermally activatable means (45) for short-circuiting the first and second contact elements (6; 3). The first and second contact elements have respective first and second regions (6; 3) facing each other, and said thermally activatable means (45) is mechanically linked to the first contact element (6).

6 Claims, 2 Drawing Sheets

THERMALLY-ACTIVATED SWITCH FOR SHORT-CIRCUITING A BATTERY CELL

The present invention relates to a thermally activated short-circuiting switch designed to be connected in parallel with a battery cell and having first and second contact elements which are distinct from the electrodes of a diode, and thermally activatable means for causing the first and second contact elements to be short-circuited. The switch has a first state in which it is not activated and a second state in which it is activated and forms a short circuit between the first and second contact elements.

BACKGROUND OF THE INVENTION

A large number of solutions enabling a thermally-activated short-circuiting switch to be connected in parallel with a battery cell have been proposed in the past.

In particular, some solutions take advantage of the fact that when the battery cell becomes faulty and becomes open circuit, a bypass diode is generally provided to allow current to continue flowing through the other battery cells that are connected in series with the faulty cell.

The flow of current through the diode causes the diode to heat up, and a switch of a first type makes use of this rise in temperature to establish a short circuit directly between the anode and the cathode of the diode.

Thus, for example, European patent EP-0 173 690 (Hughes Aircraft Company) proposes short-circuiting the electrodes of a bypass diode, either by causing a solder preform to run by a wick effect, thereby short-circuiting the contacts, or else by producing mechanical deformation of an electrode pressed against the diode and serving to establish a short circuit with another electrode on the periphery of the diode.

U.S. Pat. No. 3,213,345 (Mallory) proposes a bypass diode having an electrode urged resiliently towards the periphery of its package in a short-circuit position and soldered to the diode by solder which is caused to melt by a high current passing through the diode, thereby establishing the desired short circuit.

Finally, German patent DE-1 613 968 (Brown Boveri) proposes a device comprising two anti-parallel diodes which device is short-circuited by an alloy melting in the event of bypass current flowing, the short circuit taking place in a cavity situated in the bottom portion of the diode and producing a short circuit at the periphery thereof.

Each of the solutions described above suffers from the drawback of depending on the particular shape of the electrodes of the diode. Thus, European patent EP-0 173 690 establishes a short circuit on a ring constituting the outside of the diode, which means that it is difficult to obtain contact that is reliable, having low resistance, and enabling a high nominal current to pass. U.S. Pat. No. 3,213,345 provides contact that is very small only, since the resilient electrode soldered to the diode cannot be very large in size. Finally, the solution proposed in German patent application DE-1 613 968 also depends closely on shape, in particular of the diode, in order to be able to achieve sealing around the periphery thereof, and it also implies that the diode remains in a vertical position since flow takes place by gravity. Such a solution is unsuitable for use on board a satellite, in particular.

In European patent application EP-0 226 360 (Powerplex Technologies) a switch is described that is similar to the first above-specified type and that uses a zener diode in parallel with a battery cell. In the event of the battery cell failing, the battery current flows through the zener diode by melting it, providing the package of the diode is not damaged. This short-circuiting makes use of a mechanism that is not well understood, thereby making it difficult in practice to control the value of the contact resistance, and in particular the reproducibility thereof.

From the above, it results that however attractive it may appear, implementing short-circuit switches of the first type by producing a direct short circuit between the electrodes of a bypass diode suffers from drawbacks and/or limitations in practical implementation that are quite severe.

A second type of switch makes a short circuit directly across the battery cell.

PCT application WO 88/00400 (Hughes Aircraft Company) thus proposes using an electrode that is soluble in the electrolyte of the cell. That solution turns out to be difficult to implement, since the desired short circuit is obtained by nickel being deposited on the electrode. In addition, the resistance of the short-circuit contact and the possibility of allowing a high current to pass are not guaranteed.

A third type of switch achieves a short circuit without directly short-circuiting the contacts of bypass diodes. Such switches, which may optionally be connected to the electrodes of a bypass diode, are also described in a certain number of prior publications.

U.S. Pat. No. 5,025,119 (Hughes Aircraft) describes a short-circuit switch implementing a self-solderable resilient blade contact controlled by an electromagnetic coil. This implies that a sensor detects faulty operation of the battery cell and activates the electromagnetic coil. In other words, the operation of that device depends on the reliability of an external circuit which gives rise to qualification problems for a system on board a satellite which needs to be effective for very long missions, e.g. exceeding five years, and possibly as long as fifteen years.

European patent application EP-0 372 823 (Hughes Aircraft) describes a short-circuiting device connected in parallel with a bypass diode of a battery cell and controlled by a thermal switch which itself uses a relay to actuate a main contact capable of passing all of the current flowing through the battery cells connected in series with the faulty cell. As in the preceding case, implementation depends on the reliability of several electronic components.

U.S. Pat. No. 4,061,955 (NASA) describes a short-circuiting circuit comprising a fault-detecting semiconductor device coupled with a relay. As before, that technique suffers from drawbacks of reliability associated with having an electronic circuit for detecting a fault.

Finally, U.S. Pat. No. 4,252,869 (Dow Chemical) describes a device for short-circuiting two electrodes, a central electrode and an electrode disposed concentrically thereabout, in the event of heating caused by current passing because of a faulty battery cell breaking an ampoule containing a conductive liquid which forms a short circuit between the two above-mentioned electrodes. That device can operate only under gravity, and it is not usable in weightlessness on board a satellite.

OBJECTS AND SUMMARY OF THE INVENTION

The present invention provides a thermally activated short-circuiting switch designed to be connected in parallel with a battery cell and having first and second contact elements that are distinct from the electrodes of a diode, i.e. a switch of the third above-mentioned type, and that makes it possible to achieve reliable operation without associated electronics, and to establish a short-circuit contact of low ohmic value and suitable for conveying a high current, and which is also suitable for being used in a satellite, i.e. firstly in a state of weightlessness, and secondly ensuring reliable operation over a long period of time corresponding to the duration of the on-board mission, e.g. five to fifteen years.

To this end, in the short-circuiting switch of the invention the first and second contact elements have first and second regions which face each other, and said thermally activatable means is mechanically linked at least to the first contact elements in said first state of the switch.

The face-to-face disposition of the first and second contact regions makes it possible to ensure good contact area and good quality of contact. Since the thermally activatable means is mechanically associated with the first contact element, the desired short-circuiting is obtained merely by heating the thermally activatable means independently of any associated electronics. The device of the invention thus implements mechanical and/or physical phenomena that are simple and that make it possible to ensure satisfactory reliability for the switch, even for missions of long duration.

In a first embodiment, the short-circuiting means comprises a metal element having shape memory constituting said thermally activatable means, together with a retaining element for retaining the first contact element, the retaining element being suitable for moving under the action of the shape-memory metal element between a first position corresponding to said first state of the switch and a second position corresponding to the second state of the switch.

Advantageously, the first contact element includes a flexible contact having a fixed first end and a moving second end. The shape-memory metal element is then elongate in shape and has a fixed first end and a second end housed in a rocker having a locking region which holds said second end in place at least in said first state of the switch. In particular, the shape-memory metal element is advantageously a U-shaped wire looped around the rocker. As a result, the wire is easily heated since both ends of the wire are accessible at the first fixed end.

Advantageously, the second end of the first contact element is fixed to the locking region of the rocker. In a preferred embodiment of this variant, the rocker includes a spring disposed to apply a contact force between the first and second contact elements in the second state of the switch.

In a second embodiment, the first contact element includes a cylindrical chamber containing a deformable conductive mass in contact with the inside wall of the cylindrical chamber, the conductive mass constituting said first region of the first contact element, and the cylindrical chamber includes a residual portion which is situated remote from the second contact element and which is filled with a thermally expandable material constituting said thermally activatable means whose expansion under the action of heat has the effect of displacing the deformable conductive mass while deforming it so as to achieve the second state in which contact is made between the first contact element and the second contact element. For example, the deformable conductive mass is made of indium. Preferably, the thermally expandable material is a wax. It is advantageous for the device to include a sealing gasket disposed between the thermally expandable material and the deformable conductive mass.

The cylindrical chamber may be made of an electrically conductive material.

The second contact element may include a finger extending longitudinally towards the deformable mass, and the first contact element includes an element having a cylindrical region surrounding the finger and spaced apart therefrom, the short circuit of the second state being obtained by the deformable mass being extruded through the cylindrical region.

Preferably, the end of the cylindrical region directed towards said deformable mass flares towards said mass so as to form a chamfer favorable to extrusion of the deformable mass.

In a third embodiment, the first contact element includes a housing in which a mass of metal is disposed constituting said thermally activatable means, and the first and second regions of the first and second contact elements are separated by a cavity of a height that is smaller than the height of the dome of liquid that the mass of metal housed in the first contact element would tend to form in an empty space. As a result, melting of the metal mass housed in the first contact element provides connection with the second contact element by capillarity, thereby providing a short circuit of excellent ohmic quality.

It is advantageous for the housing to include an annular ring and a plane face within the annular ring and facing the second contact element.

In a preferred implementation of this third embodiment, the housing includes an outline coated in a material that is not wettable by said mass of metal when the metal is in a liquid state. This makes it possible to direct formation of the liquid drop preferentially towards the second end of the contact.

BRIEF DESCRIPTION OF THE DRAWINGS

Other characteristics and advantages of the invention appear more clearly on reading the following description given with reference to the accompanying drawings, in which.

MORE DETAILED DESCRIPTION

Figure 1:
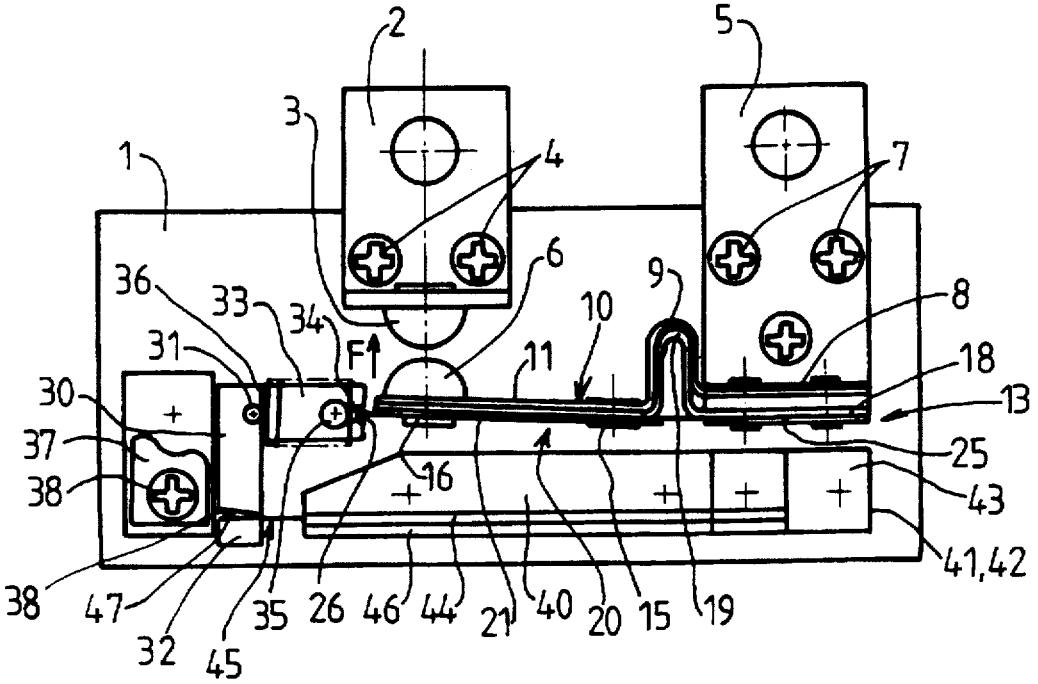
FIG. 1 is a plan view of a first embodiment of the invention.

Space vehicles, and in particular satellites, now use nickel hydrogen batteries which have progressively taken over from nickel cadmium batteries. Nickel hydrogen batteries have a longer lifetime and greater energy density (about 200 kJ/kg). A single cell in a battery has a nominal voltage of 1.24 V, which means that in order to obtain a nominal voltage of 28 V for powering a space vehicle, 20 to 30 individual cells are connected in series. Each individual cell is pressurized with hydrogen to a pressure that may be as great as 40 bars. The possibility of hydrogen leaking is a major cause of such a cell failing and it has the result of the cell becoming open circuit. That is why it is conventional to provide for a short-circuiting switch across each cell to avoid compromising operation of the entire battery in the event of only one or several individual cells fail.

A short-circuiting switch must be capable of conveying high currents while dissipating very little power, i.e. it must guarantee very low contact resistance. In addition, it must be capable of remaining in the open state for the entire duration of a mission, e.g. 5 years to 15 years, and it must also be capable of remaining in the closed state for the total duration of a mission, i.e. likewise for 5 years to 15 years.

Critical factors are thus reliability, mass, and heat dissipation when passing high currents.

As mentioned above, problems of reliability over a long period during which the device need not be activated or verified in any way, rule out the use of auxiliary circuits which could themselves be subject to unforeseeable failure.

That is why the present invention seeks to make use of devices that implement mechanical and/or physical phenomena that are simple and that do not depend on the state of weightlessness, or where appropriate, of very low gravity, in which a space vehicle finds itself.

Typical satellite configurations are given below as examples:

1) a geostationary telecommunications satellite with two nickel hydrogen batteries, so temporary disconnection of one of the batteries can be accepted;

2) a geostationary telecommunications satellite with only one nickel hydrogen battery, in which case interruptions of very short duration only can be accepted;

3) a ground observation satellite in low orbit having a period of 90 minutes has an eclipse period of 35 minutes during each orbit, and it is fitted with four nickel hydrogen batteries. The batteries provide electricity during the eclipse period (35 min) and they are recharged during the remainder of the orbit (55 min).

The orbital lifetime of the system is 5 years in low orbit and 15 years in geostationary orbit. These figures correspond respectively to 41,000 and to 5,500 charge/discharge cycles.

The batteries are charged from panels of solar cells comprising a certain number of cells connected in series and operating in the constant current portion of their characteristic curve. A battery charge regulator makes it possible to use the solar cell panel when its power is high, thereby recharging the battery(ies).

For example, with geostationary satellites, a battery is used having a capacity of 150 Ah, with a charging time of 10 hours at a current of 12.4 A and a discharge time of 72 min at a nominal current of 94 A. For example, with a satellite in low orbit, it is possible to use a battery having a capacity of 75 Ah with a charging time of 60 min using a charging current of 35 A, with a discharge time of 30 min and a nominal current of 50 A.

The conventional solution for bypassing a battery cell makes use of a series-connection of three diodes connected in parallel with the cell, the forward direction of the diodes corresponding to battery charging, and/or one diode connected in parallel with the cell having its forward direction corresponding to discharging.

The prior art devices mentioned in the introduction to the present specification serve, in the event of cell failure, to establish a genuine short circuit around the cell after a certain response time during which current flow is nevertheless maintained when the above-mentioned diode circuits are used.

The invention proposes a short-circuiting switch that enables high currents to be passed with low thermal dissipation because of the low contact resistance achieved by the geometrical disposition of the invention, whereby ohmic contact is obtained frontally by linear displacement. Also, according to the invention, the thermally activatable means is mechanically linked with one of the contact elements, thereby making it possible to omit trigger systems requiring external elements, such as electronic trigger systems.

FIG. 1 shows a first embodiment of the invention implementing a metal wire 41 having shape memory. It is recalled that a metal having shape memory is suitable for changing state when raised to a temperature above a given temperature. In its final state, the material has dimensions smaller than those it had in the initial state, and in particular, for a metal wire, that corresponds to linear contraction.

The device shown in FIG. 1 has a baseplate 1 on which support plates 2 and 5 are fixed by means of respective screws 4 and 7. The support plate 2 has a fixed contact 3 in the form of a hemisphere and the support plate 5 carries a moving blade 10 with a contact region 6 that is likewise in the form of a hemisphere in this case, and that is disposed facing the contact region 3. More particularly, the moving contact has two superposed resilient blades respectively 10 and 20 which are secured to an extension of the support plate 5 at respective ends 8 and 18 thereof. Each of the blades 10 and 20 also has a respective region 9 and 19 bent into a U-shape. Electrical contact between the contact region 6 and the contact-making region situated on the support plate 5 is provided by copper strips, e.g. twelve copper strips that are 0.1 mm wide and that form a flexible current path between the contact region 6 and the contact-making region. The function of the U-shaped regions 9 and 19 is to enable the blades 10 and 20 to move without exerting tension on the copper strips 25.

A support plate 40 of elongate shape, disposed in this case beside the flexible blades 10 and 20 and running parallel thereto, has two contact regions 41 and 42 at its rear end 43 for conveying a current that heats the ends of a wire 45 which, in side view, is generally U-shaped with its branches 44 being received in a guide 46. The central region of the wire forming the bar of the U-shape and referenced 47 is folded around a semi-annular groove 38 disposed at one end 32 of an arm of a rocker 30 pivoted about an axis 31 perpendicular to the plane of the baseplate 1. The rocker 30 is generally L-shaped. The branch 33 of the L-shape has an opening 35 towards its end which communicates with the end of the branch via a slot 34 receiving an extension 36 situated at the moving ends of the moving blades 10 and 20, and secured in this case to the flexible blade 20.

Finally, a support plate 37 mounted on the baseplate 1 by a screw 38 serves as an abutment against rotation of the rocker 30 pivoted about its axis 31.

The device described above has two stable states. So long as the shape-memory wire 45 has not been heated by application of a voltage or a current to its ends 41 and 42, the device remains in the configuration shown in FIG. 1. In the event of a battery cell failure, the bypass current is applied to the shape-memory wire 45. For example, the wire 45 is connected in series with the bypass diode whose forward direction corresponds to the discharge direction of the cell. Thus, in the event of a cell failing, the wire 45 is heated and it exceeds the transition temperature for switching to the second state in which it is shorter in length, thereby causing the rocker 30 to rotate counterclockwise, having the effect of causing the moving contact constituted by the blades 10 and 20 to move in the direction of arrow F, it being given that it is driven by its end 26 engaged in the slot 34 of the branch 33 of the rocker 30. In addition, a bearing force between the contacts 3 and 6 delivered by a spring 36 whose end bears against the extension 26 tends to press the moving blades 10 and 20 and thus the contact 6 against the contact 3 in the direction of arrow F. In contrast, in the position shown in FIG. 1, the force provided by the spring 36 is situated practically on the axis of the moving contact 10, 20.

In the first state as shown in FIG. 1, the spring 36 bears against the end of the moving blade 10 (extension 26) with a force of about 2 N, for example, thus ensuring that the blade 10 does not move under the action of vibration or of acceleration.

When the device is actuated, the rocker 30 rotates towards the second state. As soon as it goes past its central, equilibrium position, the spring 36 forces the assembly comprising the rocker 30 and the blade 10 towards the active position in which the contact 6, 34 is closed.

Figure 2:
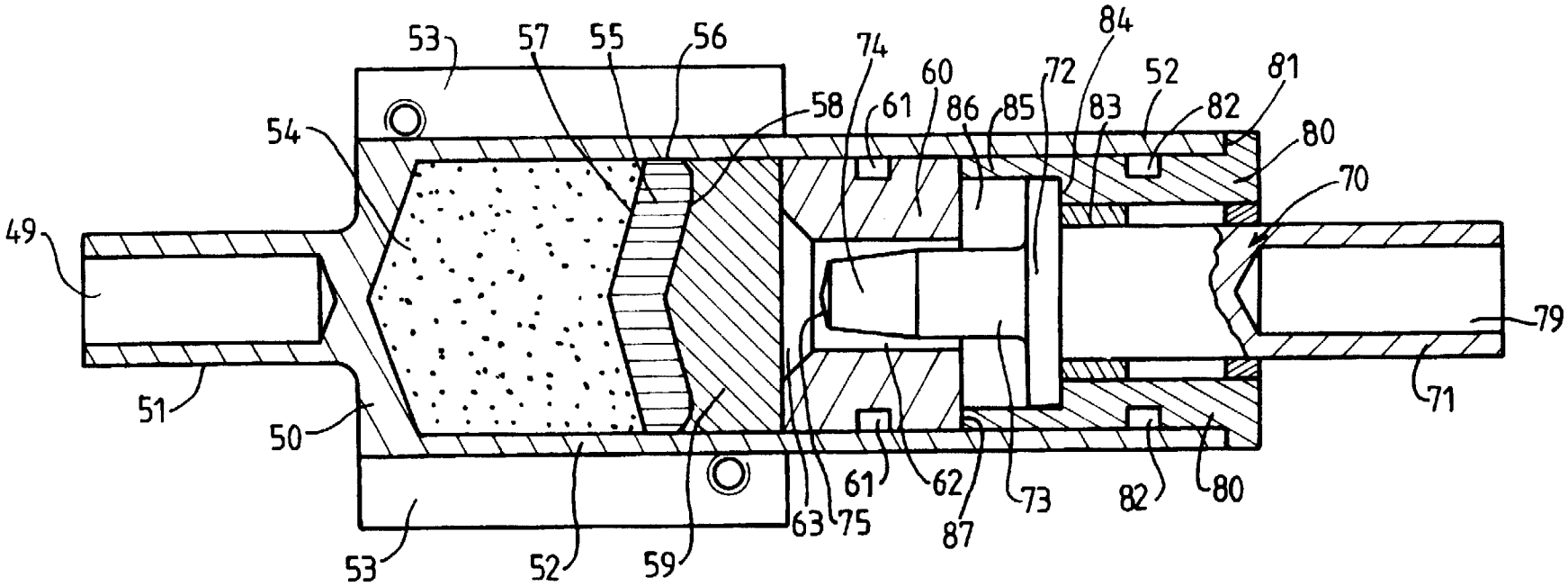
FIG. 2 is a longitudinal section view through a second embodiment of the invention.

FIG. 2 shows a second embodiment of the invention. The switch comprises a first sleeve 50 generally made of conductive material which has a cylindrical region 51 at its rear portion provided with a blind contact opening 49 and having a front portion constituted by a hollow cylinder 52 comprising, in succession, a wax plug 54, an optional resilient gasket 55, a plug 59 of an extrudable material such as indium, an electrically conductive part 60 whose outside diameter is nominally equal to the inside diameter of the part 52 and having a sealing gasket 61, the part 60 having a generally cylindrical central opening 62, and finally an electrically insulating cylindrical sleeve 80 engaged in the end of the cylindrical region 52 and coming into abutment at 81 thereagainst and at 87 against the cylindrical part 60.

The rear cylindrical portion 71 of the contact 70 has a blind contact opening 79 with a central collar 72 in abutment at 84 against the non-conductive cylindrical part 80, and a front portion constituted by a cylindrical finger 73 received in the cylindrical central opening 62 and including a frustoconical extension 74 terminating in a conical end 75.

The two contacts are short-circuited by heating the wax plug 54 which has a large coefficient of thermal expansion and which moves the plug of extrudable material 59 towards the end finger 73. Extrusion takes place through the central opening 62 of the cylindrical part 60 which is advantageously conically flared at 63 towards the indium plug 59. In addition, an annular reservoir 86 surrounding the root of the finger 73 serves to provide an additional expansion volume for the indium plug 59. When the wax 54 is subjected to a rise in temperature, which may be provided, for example, by the heat given off by one or more diodes bypassing the battery cell, it causes the resilient gasket 55 to move and the indium to be extruded through the frustoconical portion 63 which forms a front short circuit with the end 75 of the finger 73. This displacement may optionally continue so that the indium 59 penetrates into the space 62 which tapers progressively towards the root of the finger 73 and finally opening out into the expansion cavity 86. The configuration described provides a large contact area that encourages low contact resistance, thus encouraging the passage of high currents of the kind encountered in the intended application.

The wax used is preferably the expansion wax sold under the name WESTOWAX DW 91/846 by HÜLS AG, D-45764 MARL (Germany).

It should be observed that, in section, the resilient gasket 55 is chevron-shaped, having two frustoconical regions 57 and 58 directed towards the finger 73.

Figure 3:
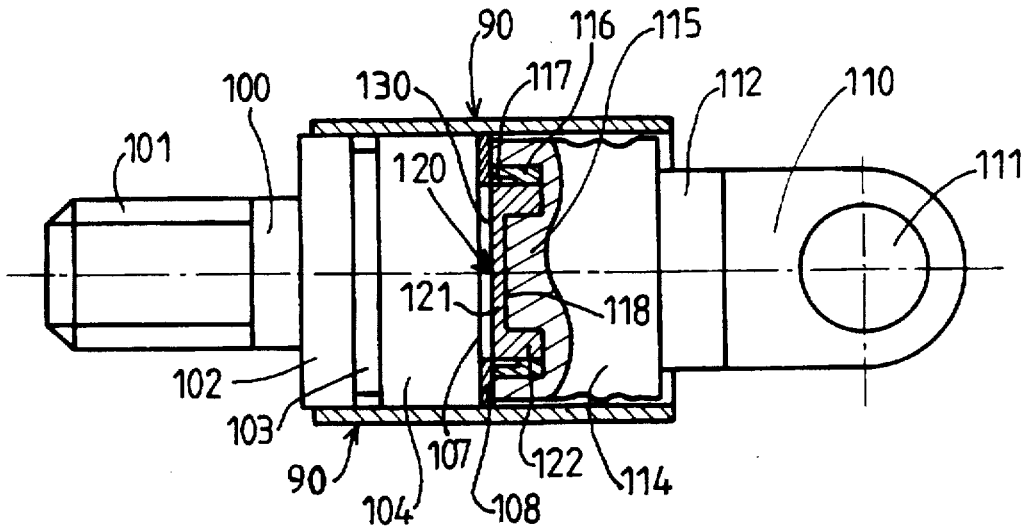
FIG. 3 is a fragmentary longitudinal section view through a third embodiment of the invention.

FIG. 3 shows a third embodiment of the invention in which the two electrodes 100 and 110 are disposed face to face in a sleeve 90. The electrode 100 has a contact-making region 101 and the electrode 110 has a contact-making region 111. The electrode 100 has a cylindrical region 102, an annular groove region 103 and a front cylindrical region 104 which comes into abutment against an insulating separator washer 108 separating the front cylindrical portion 104 of the electrode 100 from the front cylindrical portion 115 of the electrode 110. The cylindrical region 115 has a plane front face 118 surrounded by an annular opening 117. A low melting temperature alloy 120, e.g. an indium-tin eutectic alloy, is housed in the annular space 117 and also covers the front face 118 at 121, forming a plane face 130. It will be observed that the portion 122 of the alloy which is disposed in the annular space 117 is surrounded by a material that is not wettable by the alloy 120, e.g. a ring 116 of polytetrafluoroethylene (PTFE).

The space available between the front face 107, the cylindrical portion 104, and the front face 130 of the alloy 120 is selected in such a manner that the height h available between the faces 118 and 107 is less than the height of the dome of liquid that would tend to be formed in an empty space by the metal mass 120 that is housed in the annular space 117 and on the face 118. Thus, when the mass 120 is heated above its melting point, the liquid dome which tends to form under capillary forces produces a high-quality short-circuit between the front ends 104 and 114, and thus between the two contacts to be short-circuited, i.e. a contact having low resistance and capable of carrying a high current, of the kind encountered in the intended application.

The embodiments of the invention shown in FIGS. 2 and 3 require an external source of heat. For faults that occur during battery discharging, it is possible to use the heat generated in a temporary bypass diode. If the fault to be compensated is liable to occur during battery charging, or if the temporary bypass diode is not included in the system, it is possible to use a heating resistance disposed in parallel with the battery cell under consideration. In the FIG. 2 case, the resistance may be disposed inside the mass of wax 54.

What is claimed is:

1. A thermally activated short-circuiting switch designed to be connected in parallel with a battery cell comprising; first and second contact elements, thermally activatable means for causing the first and second contact elements to be short-circuited, the switch having a first state in which it is not activated and a second state in which it is activated and forms a short circuit between the first and second contact elements, the first and second contact elements have first and second regions which face each other, and said thermally activatable means being mechanically linked at least to said first contact element in said first state of the switch; said first contact element including a housing and a mass of metal disposed therein constituting said thermally activatable means, said first and second regions of the first and second contact elements are spaced apart such that dome of liquid which tends to form upon melting of the mass of metal produces a short-circuit between said first and second regions.

2. A switch according to claim 1, wherein said first and second regions are separated by a cavity having a height that is smaller than the height of the dome of liquid that the mass of metal housed in the first contact element would tend to form in an empty space.

3. A switch according to claim 2, wherein the housing includes an annular ring and a plane face within the annular ring and facing the second contact element.

4. A switch according to claim 2, wherein the housing includes an outline coated in a material that is not wettable by said mass of metal when the metal is in a liquid state.

5. A switch according to claim 1, wherein the housing includes an annular ring and a plane face within the annular ring and facing the second contact element.

6. A switch according to claim 1, wherein the housing includes an outline coated in a material that is not wettable by said mass of metal when the metal is in a liquid state.

* * * * *